US006334706B1

(12) United States Patent
Meyrat et al.

(10) Patent No.: US 6,334,706 B1
(45) Date of Patent: Jan. 1, 2002

(54) MULTI-FUNCTION PUSH-BUTTON CONTACT CLAMP

(75) Inventors: Clément Meyrat, Le Landeron; Laurent Pantet, Saint-Imier, both of (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 09/669,906

(22) Filed: Sep. 27, 2000

(30) Foreign Application Priority Data

Sep. 29, 1999 (CH) ..... 1781/99

(51) Int. Cl.[7] ..... G04B 29/00

(52) U.S. Cl. ..... 368/321

(58) Field of Search ..... 368/185, 187, 368/308, 319, 321

(56) References Cited

U.S. PATENT DOCUMENTS 4,031,341 A * 6/1977 Wuntrich et al.
4,241,441 A * 12/1980 Murata ..... 368/247

FOREIGN PATENT DOCUMENTS

| | | |
|---|---|---|
| CH | 568 612 | 10/1975 |
| DE | 347 620 | 7/1920 |
| GB | 2 040 517 | 8/1980 |

* cited by examiner

*Primary Examiner*—Vit Miska
(74) *Attorney, Agent, or Firm*—Sughrue Mion, PLLC

(57) ABSTRACT

The contact clamp (20) includes a base (21) secured to the back cover of a case on one side of a push-button (10) and an elastic strip (22) extending beyond the push-button of which a first pre-stressed portion (23, 24) forms the key and return spring and a second portion (25, 26, 27) of greater flexibility allows, at its end (28), a contact to be closed with less force than that which has to be exerted on the push-button.

7 Claims, 3 Drawing Sheets

MULTI-FUNCTION PUSH-BUTTON CONTACT CLAMP

The present invention concerns a multi-function contact clamp made in a single piece of simple and economic design which acts like a key to prevent the push-button being removed once it has been set in place, like a return spring in a neutral position and like contact means for example on a printed circuit contact pad.

The invention also concerns a contact device wherein several clamps of the preceding type are positioned end-to-end.

Such a clamp, or contact device, finds application in very varied fields, more particularly in the control of electronic apparatus of small dimensions, such as timepiece parts.

In push-button devices, the use of flexible elements is already known for fulfilling certain key/return spring/contact means functions, given that it is desirable for the contact force to be less than the force having to be exerted on the push-button head, in particular when said contact is established on a printed circuit contact pad.

In Swiss Patent No. 621 034, a control mechanism for a watch movement includes a wire spring which is positioned between two supports arranged on either side of the push-button stem and whose median portion is engaged in a groove of said stem, thus fulfilling the dual role of key and return spring, the contact as such being assured by the action of the end of the push-button on a tilting strip.

In U.S. Pat. No. 4,818,830, a push-button mechanism is made by means of a flat metal spring cut along a complex substantially U-shaped contour and being secured and/or guided by several studs secured to the plate, so that one of the branches has sufficient flexibility to close a contact when force is exerted thereon via the end of the push-button stem. This mechanism thus fulfils the return spring and contact means functions but has no key function.

The mechanism proposed in British Patent No. 2 040 517 is formed by a pre-cut metal strip which includes a certain number of folds outside its general plane parallel to the plate. The strip is secured at one of its ends by a bent portion anchored in the plate and by a stud secured to the plate. On the push-button stem, and close to its end, the strip has a step bringing its plane below the general plane of the plate in a recess made for this purpose. This end includes, on the one hand, an opening, one edge of which is engaged in a groove of the push-button stem to form the key and return spring, and on the other hand, a rigid lug, bent towards the exterior of the plate and located along the axis of the push-button stem to form the contact on an elastic strip located opposite. A rigid tip extending beyond the stem comes abuts to a stop against one edge of the opening to position the push-button properly and wind the strip which forms the spring. This construction enables the spring/key/contact functions to be assured by a single strip, but it will be noted on the one hand, that not only does a trip have to be shaped, but hollow deformations have to be provided in the plate, and on the other hand that the force exerted on the push-button head is directly applied at the point of contact which can consequently only be formed by a strip spring.

The object of the invention is to overcome the drawbacks of the aforecited prior art by providing a contact clamp formed by a metal strip which is cut and bent to assure at least the spring, key and contact functions, while further allowing a smaller contact force to be obtained than the force which has to be exerted on the push-button head.

The invention therefore concerns a multi-function contact clamp associated with at least one push-button having a head and a stem passing through the middle part of a case closed by at least a back cover and including a plate and a metal grid, characterised in that said clamp is formed of a single part including a plane metal base substantially parallel to the back cover and provided with means for immobilising it in the case on one side of the stem and at least one elastic strip substantially perpendicular to the base, extending beyond the stem following a portion of the inner periphery of the middle part, said strip having opposite the stem a first prestressed portion having a notch co-operating with a groove arranged close to the end of the stem to form the key and return spring in the idle position, and a second portion having greater flexibility than the first portion, the end of which closes a contact of a printed circuit with less force than that which is necessary to activate the push-button.

In the event that the case is provided with several push-buttons, for example when the case is that of a chronograph watch, contact clamps of the preceding type may be arranged facing each push-button. According to an advantageous embodiment, the bases of each contact clamp are positioned end-to-end to form a single base along the periphery of the middle part including a plurality of flexible strips.

Other advantages of the invention and the means for making it are explained in more detail in the following description with reference to the annexed drawings, in which.

Figure 1:
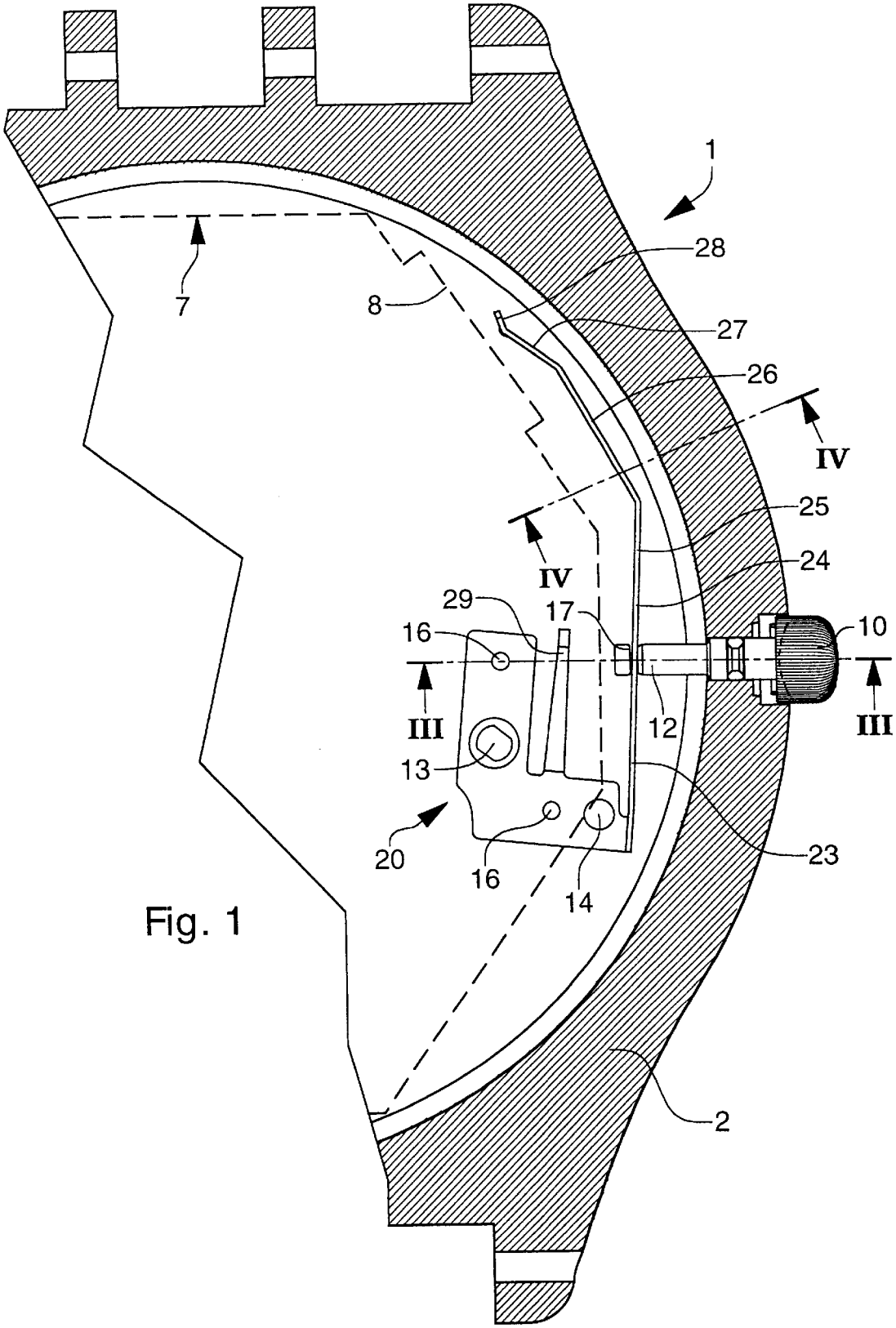
FIG. 1 is a top view of a watch case including a push-button and a multi-function contact clamp according to the invention.

With reference more particularly to FIGS. 1 to 4, a case for an electronic timepiece with a digital display, including a middle part 2 and a back cover 3 made in a single piece, commonly designated by back cover-middle part 4 and obtained for example by moulding a plastic material, is shown by way of example. Back cover 3 includes a plate 5 and a metal grid 15 shaped to accommodate and position the various components of the timepiece, represented only partially in the drawings by an LCD display module 6, below which is arranged a flexible printed circuit 7 provided with a lug 8 bent over the edge of display cell 6 to act as a contact zone. The case is closed by a crystal 9. This case 1 includes a mechanism allowing a contact to be established on a contact pad of bent lug 8 of printed circuit 7. This mechanism is simply formed of a metal multi-function contact clamp 20 activated by a push-button 10 on the head 11 of which a force F is exerted, transmitted by stem 12 which includes, close to its end, a groove 17, visible in FIG. 3. Contact clamp 20 is obtained by cutting or stamping a metal sheet along a particular contour and by bending, so as to perform at the same time the functions of key, push-button return spring and contact means, after being set in place in the case.

Figure 2:
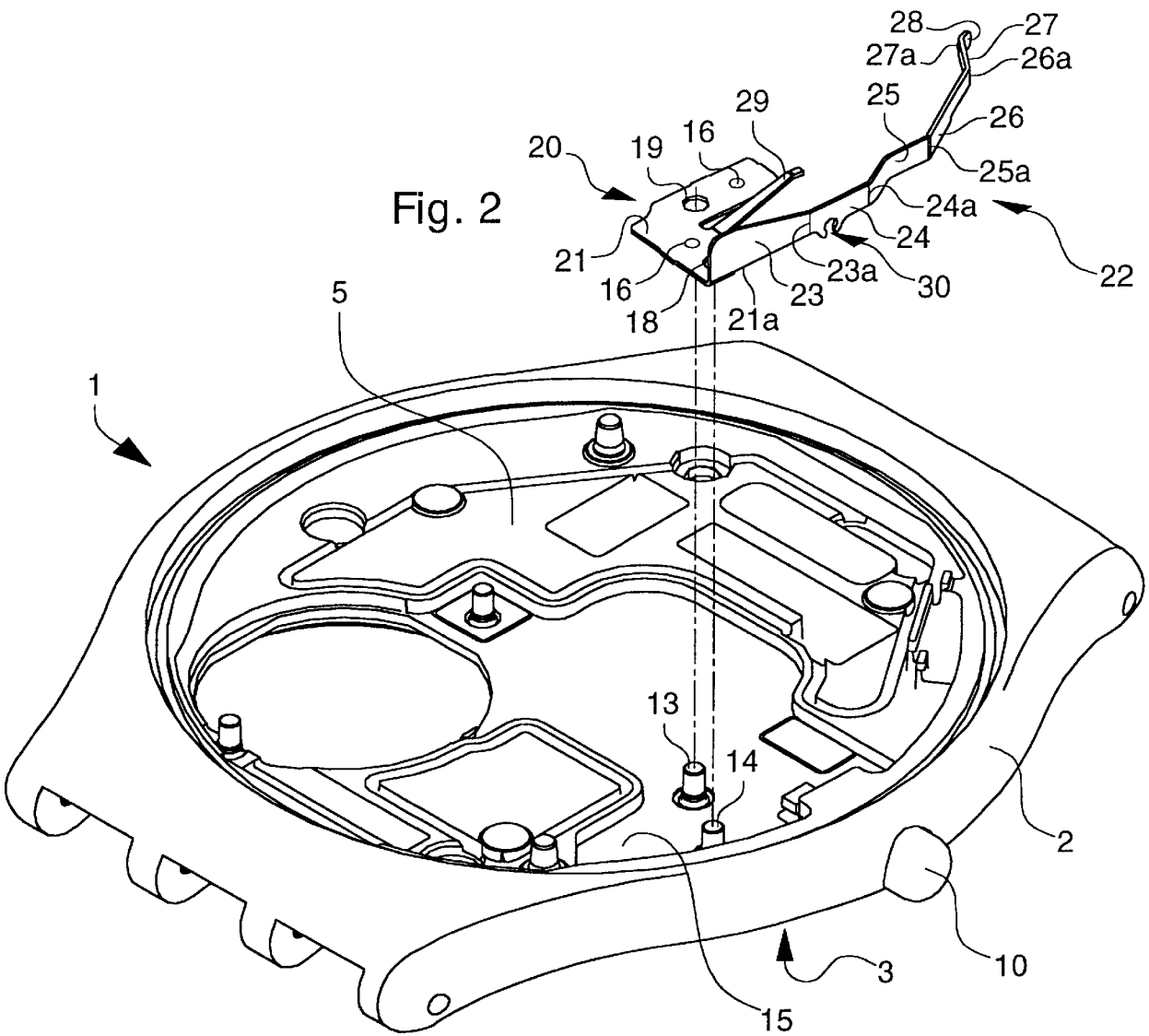
FIG. 2 is a blown up perspective view corresponding to FIG. 1.

With reference more particularly to FIGS. 1 and 2, it can be seen that contact clamp 20 essentially includes a base 21 parallel to the general plane of the case and a strip 22, perpendicular to base 21 and of which a first portion 23 is connected thereto on a part of its length by a fold 21*a*. This first portion 23 is extended beyond a fold 23*a* by a second part 24 intended to extend beyond stem 12. Part 24 includes in its median portion a notch 30 intended to engage in groove 17 of stem 12 to form a key. As will be seen hereinafter, fold 23*a* and the positioning of base 21 with respect to the inner surface of middle part 2 are effected so that the free portion of first part 23, beyond fold 21*a* and second part 24 are pre-stressed to form together the return spring of push-button 10 in the idle position.

Strip 22 extends beyond the push-button by a band like portion, connected to second part 24 by a fold 24*a* and formed of three portions 25, 26, 27 connected to each other by folds 25*a*, 26*a*, zone 27 having at its end a small lug 28 bent along fold 27*a* made to deform the strip in an opposite direction to the deformations resulting from folds 23*a*, 24*a*, 25*a* and 26*a* all made in the same direction to bend the strip along a polygonal line which substantially follows the inner wall of middle part 2. The curved shape of portion 25 results solely from construction stresses associated with the other components or supports of the movement. The band portion, formed of zones 26 and 27, is characterised in that it has over most of its length, for example from the middle of zone 26, a smaller cross section than that of the rest of the strip.

Figure 3:
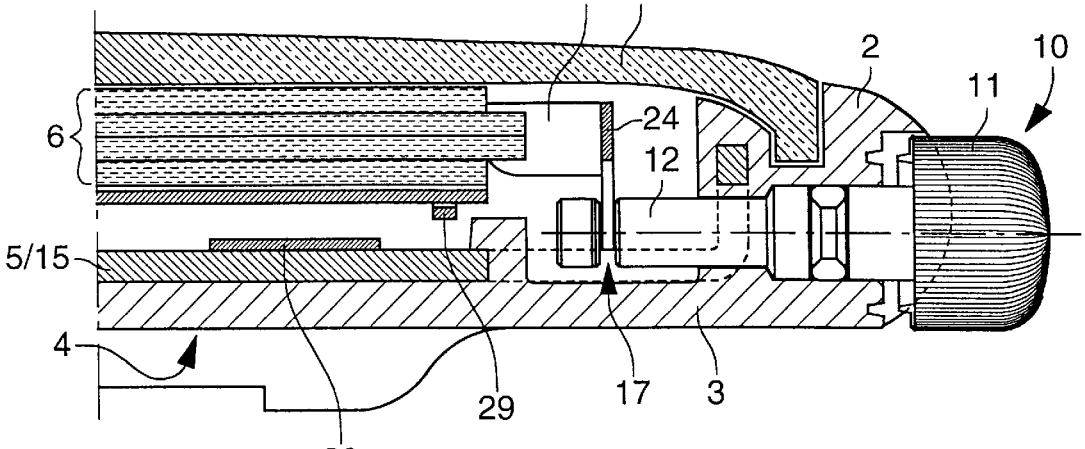
FIG. 3 is a cross-section of the push-button along the line III—III of FIG. 1.
Figure 4:
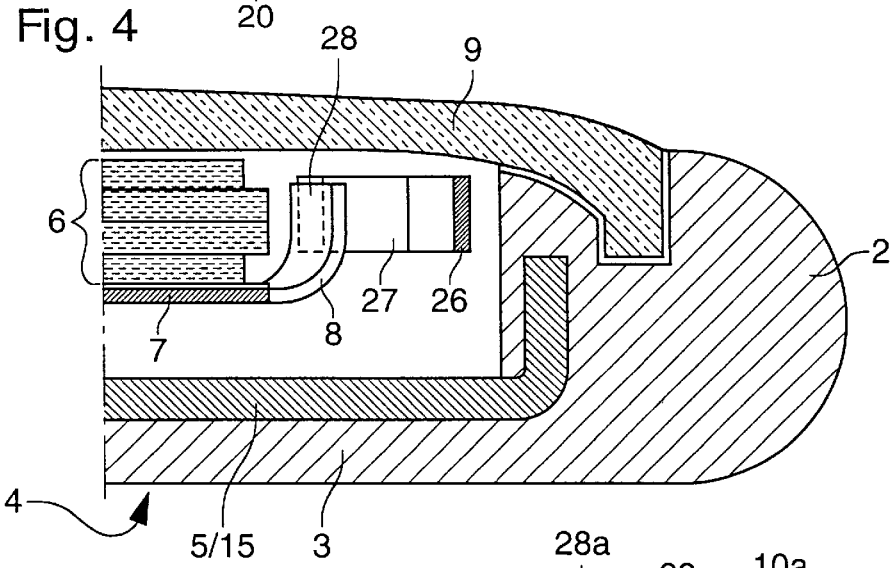
FIG. 4 is a cross-section of the contact strip along the line IV—IV of FIG. 1.

In the example shown, this smaller cross section is obtained by giving the distal portion of strip 22 a smaller width than the portion joining the base as also appears in the cross-sectional diagrams of FIG. 3 and 4. This configuration gives the distal portion greater flexibility so that bent lug 28 rests on contact pad 8 of printed circuit 7 with a force f which is less than force F which has to be exerted on the push-button.

This difference in flexibility could equally be obtained in different ways, for example by having a strip of the same width from one end to the other, and by cutting a window in the distal portion or by making said portion thinner. Likewise, one may make a strip having a greater number of folds, until it is perfectly curved to follow the inner contour of the middle part.

Base 21 of contact clamp 20 further includes a leaf 29 bent outside the general plane of the case to establish a contact for example between a zone of printed circuit 7 and the positive pole of the battery cover via grid 15.

In order to allow base 21 of contact clamp 20 to be secured to plate 5, the latter includes two holes 18, 19 in which engage two studs 13, 14 secured to the plate to allow precise positioning in the horizontal plane, the assembly being held axially by two weld points 16 on grid 15. It is clear that other equivalent means may also be used to obtain axial positioning, such as deforming the heads of studs 13, 14 or engaging washers on their end.

As is seen, the multi-function contact clamp according to the invention may be manufactured simply and economically, requires only two studs to be mounted in the back cover of the case or in a plate secured thereto, and may be set in place with a reduced number of manipulations able to be performed easily by a robot in an automatic assembly line. Indeed, with reference more particularly to FIG. 2, after setting in place push-button 10, the contact clamp need only be slightly compressed to engage notch 30 in groove 17 of the stem, then studs 13, 14 in holes 18, 19 and two weld points 16 need to be made, for example by laser.

Figure 5:
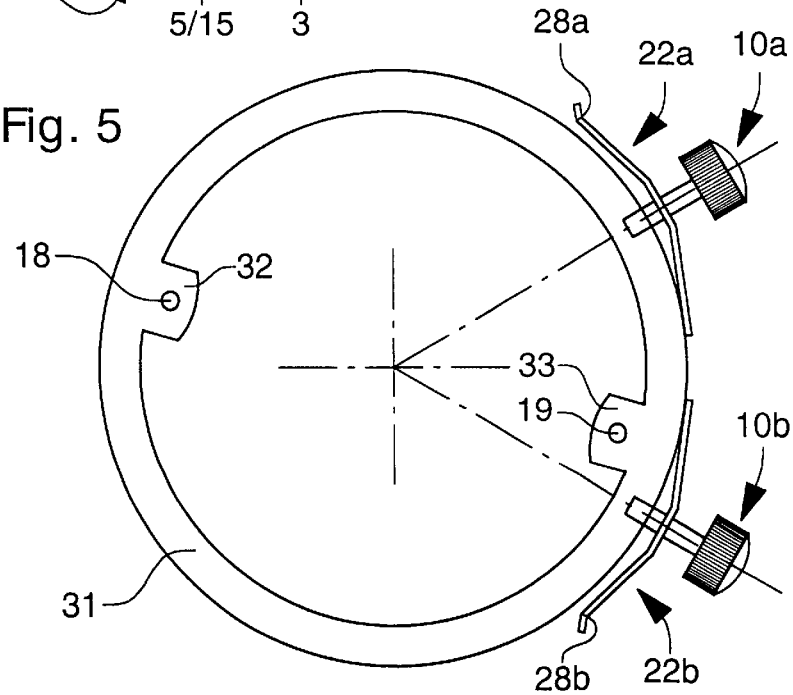
FIG. 5 is a top view of an embodiment of a contact clamp fitted to more than one push-button.

FIG. 5 shows schematically an embodiment of a multi-function contact clamp for a case including two push-buttons 10*a*, 10*b* associated with two strips 22*a*, 22*b*, as described previously, the difference lying in the fact that the bases of each clamp are jointed to form a ring 31 including two radial extensions 32, 33 in which fixing holes 18, 19 are pierced. Bent ends 28*a*, 28*b* of course rest on different contact zones of printed circuit 7.

The same arrangement is of course possible with more than two push-buttons and/or with a case which does not have a circular shape.

What is claimed is:

1. A multi-function contact clamp associated with at least one push-button having a head and including a plate and a metal grid, a stem passing through the middle part of a case closed by at least a back cover, wherein said contact clamp is formed of a single part including a plane metal base substantially parallel to the back cover and provided with means for immobilising it in the case on one side of the stem and at least one elastic strip substantially perpendicular to the base, extending beyond the stem following a portion of the inner periphery of the middle part, said strip having opposite the stem a first prestressed portion having a notch co-operating with a groove arranged close to the end of the stem to form a key and return spring in the idle position, and a second portion having greater flexibility than the first portion, and whose end closes a contact of a printed circuit with less force than that which is necessary to activate the push-button.

2. A contact clamp according to claim 1, wherein the second portion of the strip has a smaller cross-section to the cross-section of the first portion.

3. A contact clamp according to claim 2, wherein the second portion of the strip has a smaller width than the width of the first portion.

4. A contact clamp according to claim 1, wherein the immobilising means of the base are formed by two circular openings through which two studs pass, one end of which is secured to the back cover or a plate parallel to the back cover, and by two weld points on the grid.

5. A contact clamp according to claim 1, wherein the base further includes a pad bent outside the plane of the case to form a contact portion on the printed circuit.

6. A contact clamp according to claim 1, wherein the base follows the entire periphery of the middle part and includes a plurality of flexible strips arranged facing an equal number of push-buttons.

7. A timepiece including at least one multi-function contact strip according to claim 1.

* * * * *